United States Patent [19]

Jones, Jr.

[11] 4,428,129

[45] Jan. 31, 1984

[54] MOLDED SHOE SOLE CONSTRUCTION

[75] Inventor: Paul Jones, Jr., Falmouth, Me.

[73] Assignee: Kayser-Roth Corporation, New York, N.Y.

[21] Appl. No.: 383,671

[22] Filed: Jun. 1, 1982

[51] Int. Cl.[3] ..... A43B 13/28; A43B 15/00

[52] U.S. Cl. ..... 36/245; 36/78

[58] Field of Search ..... 36/14, 17 R, 17 A, 17 PW, 36/22, 31, 32 R, 78, 97, 103, 24.5, 34 A

[56] References Cited

U.S. PATENT DOCUMENTS

| | | | |
|---|---|---|---|
| 1,479,788 | 1/1924 | Ferguson . | |
| 1,743,676 | 1/1930 | Mason . | |
| 1,861,879 | 6/1932 | Quinn . | |
| 2,025,647 | 12/1935 | Daly et al. | 36/24.5 |
| 2,025,648 | 12/1935 | Daly et al. | 36/24.5 |
| 2,027,431 | 1/1936 | Hazelton et al. | 36/24.5 |
| 2,056,313 | 10/1936 | Turner | 12/142 |
| 2,103,331 | 12/1937 | Mathews | 36/17 PW |
| 2,119,363 | 5/1938 | Slosberg | 36/24.5 |
| 2,246,480 | 6/1941 | Weidner | 36/25 |
| 2,299,831 | 10/1942 | Lyon | 36/17 PW |
| 2,371,912 | 3/1945 | Perrot | 36/25 |
| 2,438,095 | 3/1948 | Phinney | 36/78 |
| 2,438.095 | 3/1948 | Phinney | 36/78 |
| 2,685,750 | 8/1954 | Cristy | 36/17 R |
| 2,995,840 | 8/1961 | Greenbaum | 36/19.5 |
| 3,133,360 | 5/1964 | Taylor, Jr. | 36/17 R |
| 3,345,664 | 10/1967 | Ludwig | 12/142 |
| 3,474,478 | 10/1969 | Batchelder et al. | 12/142 |
| 3,552,041 | 1/1971 | Batchelder et al. | 36/43 |
| 3,739,502 | 6/1973 | Auberry | 36/17 R |
| 4,176,476 | 12/1979 | Hassell | 36/44 |

FOREIGN PATENT DOCUMENTS

| | | | |
|---|---|---|---|
| 1288483 | 1/1969 | Fed. Rep. of Germany | 36/78 |
| 1123758 | 9/1956 | France | 36/78 |

*Primary Examiner*—Werner H. Schroeder
*Assistant Examiner*—Steven N. Meyers

[57] ABSTRACT

A molded shoe sole construction is provided together with a method for making an entire range of shoe sizes using only a few different molds. A trim piece including a heel and integral outsole edging is molded. The edging is sufficiently resilient to enable it to be stretched to fit a number of different outsole sizes or shapes. Slits and/or notches may be provided in the edging to facilitate this operation. The outsole may be cemented to the edging after which the shoe upper is attached thereto. A wear-resistant lift may be attached to the heel.

22 Claims, 7 Drawing Figures

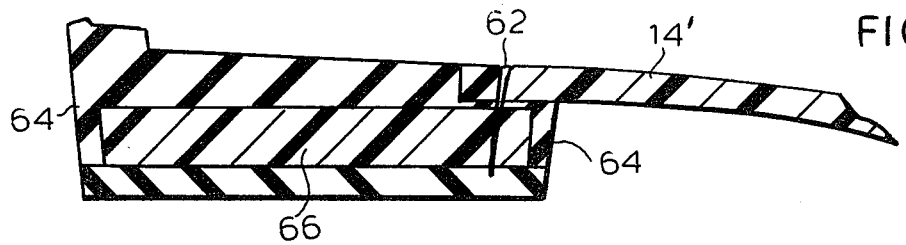
FIG.4A
FIG.4B
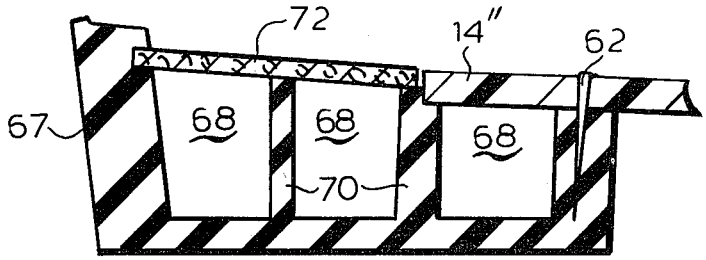
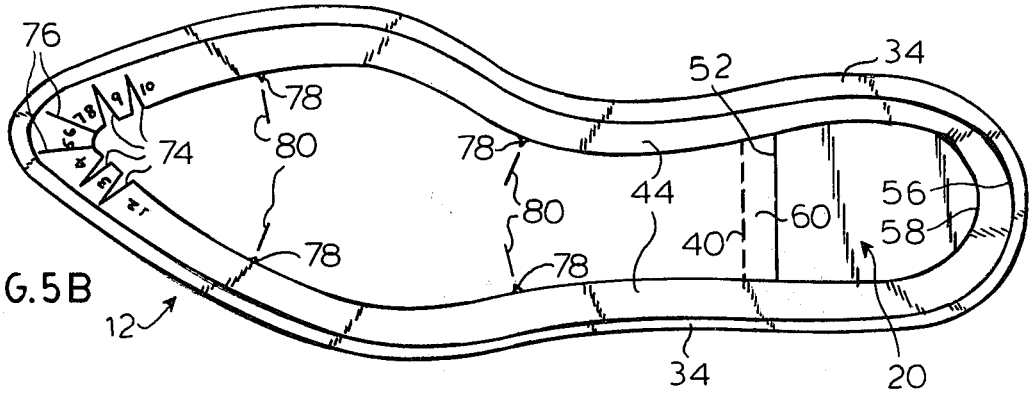
FIG.5B
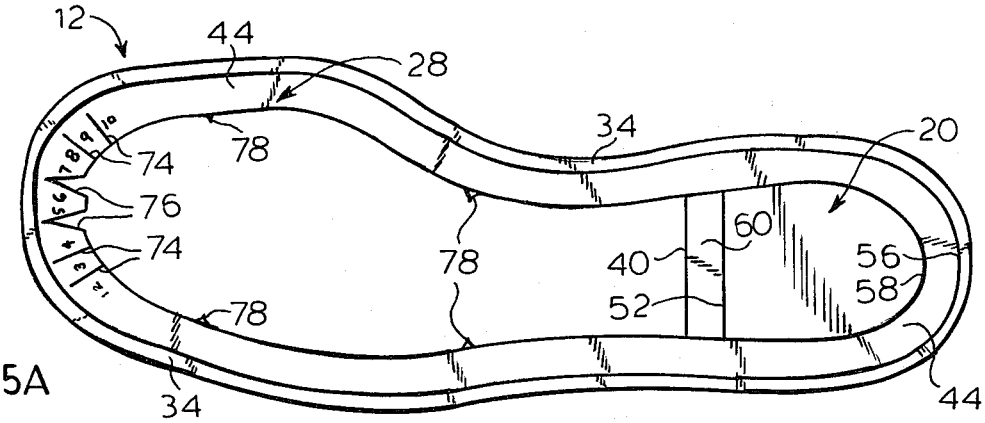
FIG.5A

MOLDED SHOE SOLE CONSTRUCTION

BACKGROUND OF THE INVENTION

1. Field of the Invention.

The field of the invention relates to the manufacture of shoes wherein one molded piece may be used in conjunction with shoes of several different sizes.

2. Brief description of the prior art.

Unit soles have been used to advantage in the manufacture of footwear for a number of years. An example of such a sole is provided in U.S. Pat. No. 2,995,840. In this patent, the sole is molded as an integral unit comprising a forepart, shank, and heel. An upper and insole are secured to the sole to arrive at a finished shoe.

The present system for making molded unit soles requires a right and left mold for each size of shoe to be made. A typical men's size run would be: 7–7½–8–8½–9–9½–10–10½–11–12–13, or 11 pair. Typical women's sizes are: 5–5½–6–6½–7–7½–8–8½–9–9½–10. The fit between the unit sole and the lasted upper is critical, and a particular unit sole can only be used with a last made to go with it. The pattern of the bottom of the last, plus an allowance for the upper leather, box toe, counter, etc., must fit very close to the raised edge of a dress unit sole, to give an acceptable appearance. This requirement puts an investment in unit sole molds at risk, because if style changes move away from the toe shape or other characteristics of a particular last, the unit soles that go with it can go "out of style" before the investment is amortized. Present costs are substantial even for plastic molds suitable for short runs of low pressure urethane foam molding, and higher for aluminum molds for vinyl materials that are injected at medium pressure. Steel molds for difficult materials are more expensive.

These costs and the style risk have limited unit soles in several ways. In medium and high grade men's shoes, the normal run is 6 to 14, not 7 to 13. Also, these shoes are usually sold in several widths, like B C D E and EEE. It is possible to combine adjacent widths onto one last bottom pattern, so that two sets of molds might cover B-C-D and E-EEE, but that is still more than double the mold cost for a limited size run in a single width. The style obsolescense risk is also greater in higher grade shoes, because it takes longer in those grades to sell enough pairs of an item to pay for the set of molds.

SUMMARY OF INVENTION

A unit sole should perform three different functions: 1. the bottom surface should have good wear resistance; 2. the surface nearest the wearer's foot should be a good cushion; and 3. the edges and the other surfaces visible in a top view should look the way the customer expects or the stylist wants them to look, to convey the desired style image. These three functions would be performed best by three different materials, usually manufactured by three different processes. Present unit soles must compromise on one material to do all three, or at most a separate material for just the heel lift.

The present invention is directed to the manufacture of a unit sole having separate parts for each of the above functions. A cavity is provided within the outsole to contain a cushion. The outsole wearing surface is cut and trimmed or "rounded" from a suitable outsole material, and similarly the wearing surface of the heel from good toplifting. The remainder of the heel, the edges of the outsole, and other visible surfaces with whatever serrations, imitation stitching, or other ornamentation are molded as in the present molded unit sole practice. All components are manufactured so that they can easily be assembled and glued together to make a practical unit sole.

The unit sole manufactured in accordance with the above procedures includes two basic parts which shall hereafter be referred to as the outsole and the trim piece. The trim piece comprises a heel portion and an integral resilient edging for the outsole. The heel portion may include a stepped portion for accomodating one end of the outsole. The edging has sufficient resiliency to allow the trim piece to be applied to outsoles of several different sizes or styles. Accordingly the mold for manufacturing the trim piece will not be rendered useless when a particular shoe model goes out of style. Since one trim piece can be used for a range of sizes, fewer molds will be necessary for manufacturing a complete line of shoes. The edging will usually, but not necessarily be integral with the heel.

BRIEF DESCRIPTION OF THE DRAWINGS

FIG. 4A is a sectional side elevation view of an alternative embodiment of the invention;

FIG. 4B is a sectional side elevation view of another embodiment of the invention;

FIG. 5A is a plan view of a trim piece;

FIG. 5B is a plan view of a trim piece having an outsole secured thereto.

DETAILED DESCRIPTION OF THE INVENTION

Figure 1:
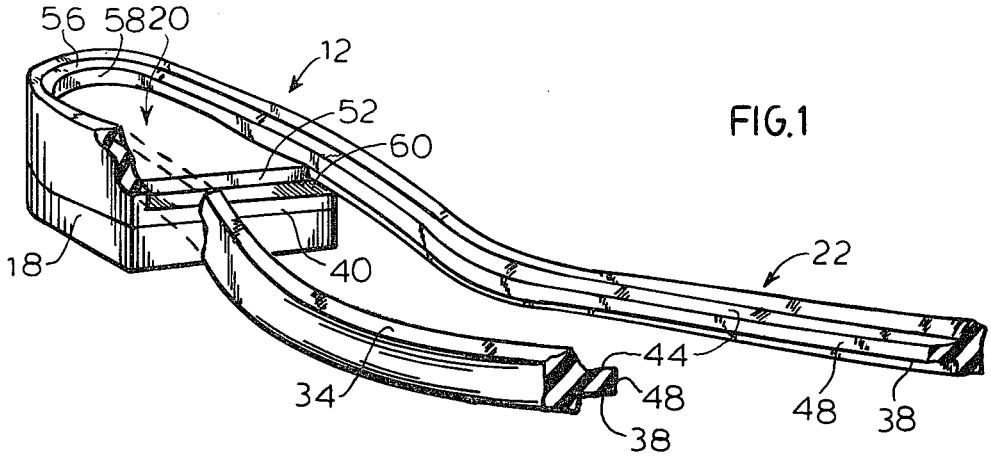
FIG. 1 is a partially cut-away perspective view of a molded trim piece.

A unit sole 10 is provided including a trim piece 12, an outsole 14, a cushion 16, and a lift 18. The trim piece 12, which is composed of a heel portion 20 and an integral edging portion 22, is made from a resilient polymeric material such as a vinyl. The edging portion 22 may accordingly be maneuvered into relatively long and narrow or short and wide shapes. The outsole 14 may be cut from leather, NEOLITE, or other wear-resistant materials. The cushion 16 may have a construction similar to that shown in U.S. Pat. No. 3,790,150. Alternatively, other cushioning means may be employed.

The trim piece 12 shown in the Figures is of integral construction and includes heel portion 20 and the edging 22 for the outsole 14. Because it does not need to have as much wear resistance as an outsole, the trim piece may be molded from materials having good stretching, handling, and cementing characteristics to facilitate its assembly with a variety of sole sizes and shapes. The edging 22 may be considerably thinner than shown in the drawings if desired.

Figure 3:
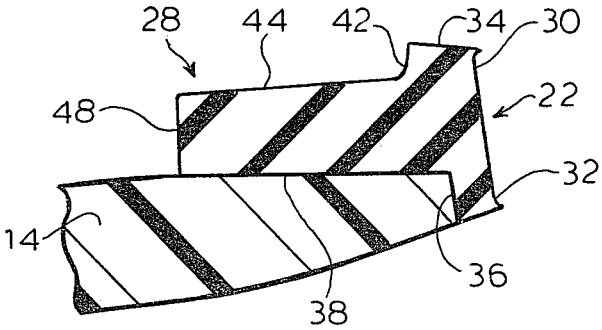
FIG. 3 is an enlarged cross-sectional view of the trim piece with an attached outsole.

Referring to FIG. 3, the edging 22 for a man's shoe has a generally T-shaped cross-sectional configuration. A longitudinal body portion 28 thereof includes a pair of vertically extending flange portions 30,32 defining the periphery of the edging. The upwardly extending flange portion 30 includes an upper surface 34 which may include decorative features such as serrations or imitation stitching. The lower flange 32 and the body portion 28 define a shoulder 36 against which the outsole 14 is positioned. The outsole is cemented to the lower surface 38 of the body portion 28 and the shoulder 36. The lower flange 32 may have a width of varying thickness, the thicker portion being at the heel breast 40 and the thinner portion toward the front of the member. In the present embodiment, the thickness ranges from about six irons to three irons. Women's shoes would have a similar construction, but are generally thinner and lighter in appearance.

The edge of the trim piece 12 has a thickness of about twelve irons and forms a shoulder 42 with respect to body portion 28. The upper surface 44 of the body portion is about three-eights of an inch in width and provides a suitable surface upon which the upper 46 of the shoe may be cemented. The flange portion 30 conceals the cement from ordinary view and gives the finished product an attractive appearance. If the stylist prefers flange 30 can be omitted, giving a thinner looking edge to the sole. This is often done in women's shoes where the light weight look is worth the extra effort required in the shoe factory to keep the glue line neat and clean.

The inner peripheral surfaces 48 of the edging 22 together with the upper surface of the outsole 14 define a cavity within which the cushion may be inserted. These surfaces 48 are substantially perpendicular to the upper surface of the outsole to prevent the cushion from slipping out of the cavity.

Figure 2:
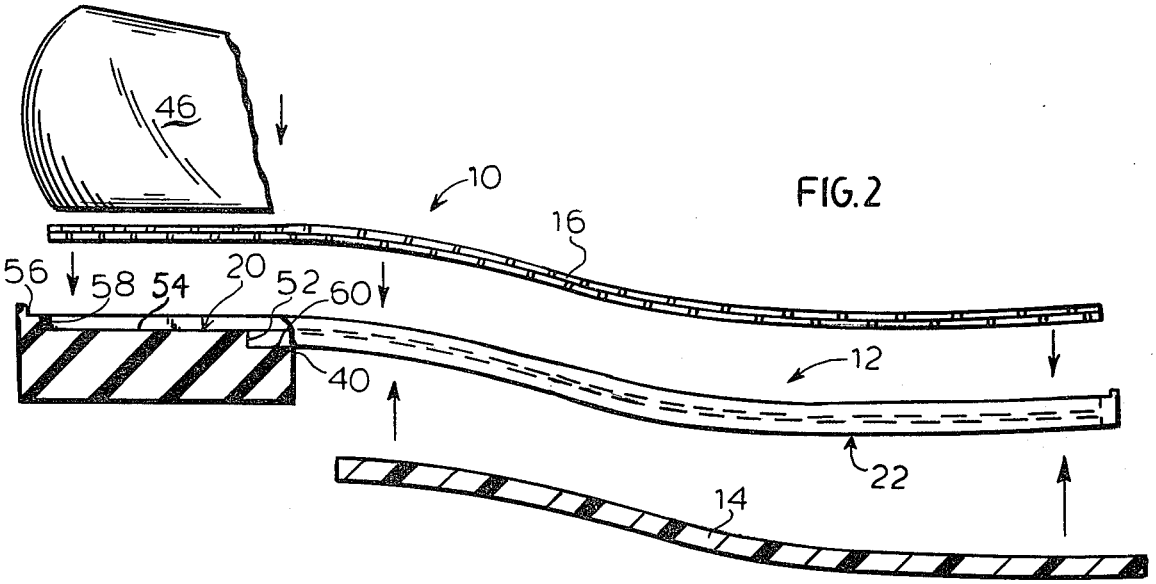
FIG. 2 is an exploded sectional view of a unit sole including a trim piece, an outsole, and a cushion.

In the trim piece shown in FIG. 2, the heel portion includes a stepped upper surface. The outsole 14 abuts the step 52 such that its upper surface is substantially coplanar with the main upper surface 54 of the heel portion. This upper surface 54, together with an upwardly projecting peripheral portion 56 defining another step 58 similar to that of the edging, forms the remainder of the cushion cavity.

The outsole 14 is wedged between the lower surface of the body portion 28 of the edging 22 and a relatively small horizontal surface 60 of the heel portion which adjoins the step 52. Nails or staples 62 may be employed for securing one end of the outsole to the heel portion.

The wearing surface or lift 18 may be applied to the heel portion as a separate piece. This is the preferred arrangement in higher quality footwear as it provides a durable material at the point in the shoe subject to the most wear. Another advantage is that the same trim piece can provide different heel heights by changing the thickness of the lift. Extreme changes in heel height would require beveled lifts. If style or marketing requirements so dictate, the heel can be made in one piece.

FIGS. 4A and 4B show two different heel core arrangements. In higher quality men's shoes with low heels, a solid heel 64 with a wood or plastic core 66 will usually be preferred. The outsole 14' extends about $\frac{5}{8}$" into the heel, and is stapled down into the core. The rest of the cushion cavity is molded into the cup of the heel. The wood core 66 permits the top lift to carry ornamental nails or slugging, if desired.

Where a heel 67 is high enough to warrant an opening or air core 68, the simplest construction is to run the outsole 14 all the way to the back to support the cushion over the core webs 70. There is a cost disadvantage to running the sole all the way back, however, so for long heels the outsole 14" can be cut off, and a heavy fiber tuck 72 used to make the floor of the cushion cavity. The joint between the outsole 14" and tuck 72 must come over a core web 70 and be well supported.

In either heel arrangement, the lower flange of the trim piece, at 32, FIG. 3, increases in width from about 3 irons at the ball to about 6 irons at the heel breast. This is to give $\frac{1}{8}$" thickness to the sides of the heel where the outsole notches into it. The transition should run smoothly so the outsole can easily be rounded, and should continue to give even more thickness at the back of the heel. The sides of the heel below or beyond the sole notch should be the usual thickness to carry the load.

FIGS. 5A and 5B illustrate the manner in which the trim piece may be employed. A trim piece 12 having a relatively wide toe portion is shown in FIG. 5A. The inwardly protruding body portion 28 thereof includes a number of slits 74 and notches 76 therein which allow the edging to be easily maneuvered into a desired shape. To facilitate attachment of the outsole 14, a sufficient number of pointers 78 are provided along the shoulders of the body portion. These pointers are intended to line up with markings 80 on the upper surface of the outsole 14 as shown in FIG. 5B. In the latter figure, the edging has been shaped to fit an outsole 14 having a pointed toe. The notches 76 shown in FIG. 5A have accordingly closed up to form slits while some of the slits have opened into notches. The markings have been aligned with the pointers to insure an accurate fitting.

The numbers molded into the cement margin 44 are used as a guide for the slits or notches that can be put in the inside flange 28 to make it easier to stretch and form it to fit a sole shape that is significantly different from the molded shape of the edging 22. As stated above, FIG. 5A shows a round toed trim piece 12 as molded, with the toe slashed and notched. FIG. 5B shows the same trim piece assembled to an extreme pointed toe pattern, aided by four slits and a W notch. The work ticket code would read S 2 3 8 9 W 5. If the numbers are properly located on all sizes of a set of trim pieces, the same code would cover all the sizes on a style of shoe. The slashes and notches can be cut rapidly on standard shoe factory die-out equipment.

It has been found that a total of four trim piece molds are all that are necessary for manufacturing an entire range of sizes of unit soles. Even more important is the fact that the same four molds can be used with many different lasts in the same heel height range. The molds will accordingly retain their value even when styles change from season to season. This is possible because the size and width shape is provided by the outsole and the trim piece is stretched to a proper fit. The techniques for economically cutting and rounding outsoles to precise size and width dimensions are well established in the shoe industry as is the practice of covering a full size and width range of men's shoes with four sizes of heels.

The sole patterns for some shoes, such as children's and some casuals, have shapes that would permit both the left and right foot to be fitted with the same trim piece. This would make a further significant reduction in mold cost.

What is claimed is:

1. A method of manufacturing footwear comprising the steps of:

providing a trim piece including a resilient outsole edging portion capable of being stretched and fitted about a plurality of sizes of outsoles;

providing an outsole;

manipulating said outsole edging portion to fit about said outsole;

securing said outsole to said outsole edging portion to form a unit sole assembly; and securing an upper to said unit sole assembly.

2. A method as defined in claim 1 including the step of molding said trim piece as an integral structure.

3. A method as defined in claims 1 or 2 wherein said trim piece includes said resilient outsole edging portion and a heel attached thereto, including the step of securing said outsole to both said outsole edging portion and said heel portion.

4. A method as defined in claim 2 including the step of providing cuts at selected locations within said outsole edging portion after the molding thereof and prior to manipulating it to fit about said outsole.

5. A method as defined in claim 4 including the step of providing a series of numbers on said outsole edging portion and providing cuts therein between certain selected numbers.

6. A method as defined in claims 1 or 2 including the steps of providing alignment means on said outsole edging portion and said outsole, and aligning said alignment means upon securing said outsole to said outsole edging portion.

7. A method as defined in claims 1 or 2 wherein said outsole edging portion has a substantially T-shaped cross-sectional configuration including a substantially flat body portion and upper and lower vertically projecting flanges along the periphery thereof, including the step of securing said outsole to said body portion.

8. A method as defined in claim 7 including the step of providing selected cuts in said body portion.

9. A method as defined in claim 3 including the step of providing a notch within said heel and inserting an end of said outsole within said notch, whereby an upper surface of said heel is substantially coplanar with the upper surface of said outsole.

10. A method as defined in claim 9 wherein said heel includes at least one air core defined by a plurality of core webs, said notch being defined by one of said core webs.

11. A method as defined in claim 10 wherein said heel includes a plurality of air cores therein, said outsole extending partially within said heel, and including the step of extending a fibre tuck over the remainder of said air cores and core webs.

12. A method as defined in claims 1 or 2 wherein a cavity is defined by the inner peripheral edges of said outsole edging portion and the upper surface of said outsole, including the step of placing a cushion within said cavity.

13. A trim piece for use in manufacturing a unit sole assembly, comprising:

a heel; and a resilient outsole edging portion integral with said heel, said outsole edging portion capable of being stretched and fitted about the circumferences of outsoles of a plurality of sizes.

14. A trim piece as defined in claim 13 wherein said outsole edging portion includes a body portion having opposing substantially flat upper and lower surfaces, and at least one vertically projecting flange defining the outer periphery thereof.

15. A trim piece as defined in claim 14 including a plurality of cuts within said body portion.

16. A trim piece as defined in claims 13 or 14 including a plurality of pointing means extending inwardly from said body portion.

17. A trim piece as defined in claim 13 including a notch within said heel portion including a substantially vertical step.

18. A trim piece as defined in claim 13 wherein said outsole edging portion includes a horizontally disposed body portion and upper and lower vertically disposed flanges projecting from the edges thereof, said lower flange having a relatively large width near said heel and a relatively small width a distance from said heel.

19. A trim piece as defined in claim 14 including upper and lower vertically projecting flanges defining the outer periphery of said body portion.

20. A trim piece as defined in claim 13 wherein said heel includes an upwardly projecting peripheral edge contiguous with said outsole edging portion.

21. A trim piece as defined in claim 20 including a notch formed in the upper surface of said heel and extending between opposing portions of said upwardly projecting peripheral edge.

22. A trim piece as defined in claim 21 wherein said notch is cut out square with respect to the upper surface of said heel.

* * * * *